US009713380B2

(12) United States Patent
Gehner et al.

(10) Patent No.: US 9,713,380 B2
(45) Date of Patent: Jul. 25, 2017

(54) CHAIR

(71) Applicant: Wilkhahn Wilkening + Hahne GmbH + Co., Bad Münder (DE)

(72) Inventors: Carsten Gehner, Hannover (DE); Michael Englisch, Blender (DE)

(73) Assignee: Wilkhahn Wilkening + Hahne GmbH + Co. (DE)

( * ) Notice: Subject to any disclaimer, the term of this patent is extended or adjusted under 35 U.S.C. 154(b) by 106 days.

(21) Appl. No.: 14/644,317

(22) Filed: Mar. 11, 2015

(65) Prior Publication Data

US 2015/0265052 A1 Sep. 24, 2015

(30) Foreign Application Priority Data

Mar. 19, 2014 (DE) ..... 10 2014 103 780

(51) Int. Cl.

| | |
|---|---|
| ***A47C 1/032*** | (2006.01) |
| ***A47C 7/14*** | (2006.01) |
| ***A47C 9/00*** | (2006.01) |
| ***A47C 5/00*** | (2006.01) |
| ***A47C 7/00*** | (2006.01) |
| ***A47C 7/40*** | (2006.01) |

(52) U.S. Cl.

CPC ..... *A47C 1/032* (2013.01); *A47C 1/03277* (2013.01); *A47C 5/00* (2013.01); *A47C 7/002* (2013.01); *A47C 7/14* (2013.01); *A47C 7/40* (2013.01); *A47C 9/002* (2013.01)

(58) Field of Classification Search

CPC ..... A47C 1/032; A47C 7/14; A47C 9/002
USPC ..... 297/314, 316, 452.18
See application file for complete search history.

(56) References Cited

U.S. PATENT DOCUMENTS

| | | | | |
|---|---|---|---|---|
| 5,588,704 | A * | 12/1996 | Harza | A47C 3/0255 297/314 |
| 5,769,492 | A * | 6/1998 | Jensen | A47C 9/002 297/188.09 |
| 6,068,280 | A * | 5/2000 | Torres | A61G 5/045 180/328 |
| 7,350,865 | B2 * | 4/2008 | Pearse | A47C 7/024 297/312 |
| 7,637,570 | B2 | 12/2009 | Becker et al. | |
| 7,691,037 | B1 * | 4/2010 | Huynh | A47C 4/54 482/123 |
| 8,662,585 | B2 * | 3/2014 | Garvis | G09B 9/12 297/314 |
| 9,504,330 | B2 * | 11/2016 | Gehner | A47C 1/03272 |
| 2002/0043846 | A1 * | 4/2002 | Brauning | A47C 3/026 297/314 |

(Continued)

FOREIGN PATENT DOCUMENTS

| | | |
|---|---|---|
| DE | 10 2007 042 032 B3 | 2/2009 |
| DE | 10 2011 001 811 A1 | 10/2012 |

*Primary Examiner* — Timothy J Brindley
(74) *Attorney, Agent, or Firm* — Renner Kenner Greive Bobak Taylor & Weber

(57) ABSTRACT

A chair includes a deformable seat shell forming a seat part and a backrest, and further includes a frame, the seat part being connected to the frame by means of a first pivot joint and the backrest being connected to the frame by means of a second pivot joint, the pivot joints allowing a twisting of the seat part and of the backrest relative to the frame caused by a deformation of the seat shell. The second pivot joint is connected to the backrest centrally in relation to the transverse direction of the chair.

16 Claims, 7 Drawing Sheets

(56) References Cited

U.S. PATENT DOCUMENTS

| | | | | |
|---|---|---|---|---|
| 2004/0195882 | A1* | 10/2004 | White | A47C 4/02 297/284.3 |
| 2009/0261642 | A1* | 10/2009 | Dickie | A47C 7/446 297/314 |
| 2012/0256458 | A1* | 10/2012 | Gehner | A47C 7/14 297/314 |
| 2014/0191550 | A1* | 7/2014 | Katoh | B60N 2/48 297/337 |
| 2015/0343924 | A1* | 12/2015 | Takeuchi | B60N 2/39 297/314 |
| 2016/0235203 | A1* | 8/2016 | Rechtien | A47C 1/024 |

* cited by examiner

CHAIR

CROSS-REFERENCE TO RELATED APPLICATIONS

This application claims priority from German Application No. 10 2014 103 780.4 filed Mar. 19, 2014, the disclosure of which is incorporated herein by reference.

FIELD OF INVENTION

The invention relates to a chair comprising a deformable seat shell, which forms a seat part and a backrest, and a frame, the seat part being connected to the frame by means of a first pivot joint and the backrest being connected to the frame by means of a second pivot joint, the pivot joints allowing a twisting of the seat part and of the backrest relative to the frame caused by a deformation of the seat shell.

BACKGROUND OF THE INVENTION

Such a chair is known from DE 10 2011 001 811 A1. The frame of the chair disclosed therein comprises a foot part and a seat base, which is rotatably connected to the foot part about a vertical axis. The seat base is connected to the seat part near the front edge of the seat by means of a first pivot joint that allows a twisting about an axis of rotation which is oriented in a vertical direction of the chair. Furthermore, a backrest support is provided, which comprises two L-shaped struts. A respective end of each strut is rotatably fixed to a respective end of a torsion rod of the seat base. The axis of rotation thus defined extends in a transverse direction of the chair and intersects the axis of rotation of the first pivot joint that is oriented in a vertical direction. The other ends of the struts are each connected eccentrically to the backrest by means of a respective ball joint.

SUMMARY OF THE INVENTION

Proceeding from this prior art, the object of the invention is to specify a chair which has the movability of the chair known from DE 10 2011 001 811 A1 but is more cost-effective to produce.

This object is achieved by a chair according to claim 1. Advantageous embodiments thereof are the subject of the further claims and will emerge from the following description of the invention.

A generic chair comprising a deformable seat shell (in the context of an intended use), which forms a seat part and a (preferably one-piece) backrest, and a frame, the seat part being connected to the frame by means of a first pivot joint and the backrest being connected to the frame by means of a second pivot joint, the pivot joints allowing a twisting of the seat part and of the backrest relative to the frame caused by a deformation of the seat shell, is characterised according to the invention in that the second pivot joint is connected centrally to the backrest with respect to the transverse direction of the chair.

In this case, the "transverse direction" of the chair shall be understood to be any direction which extends from one side of the chair (in particular from a projection of the chair in a vertically oriented plane arranged next to this side) towards the other side of the chair (in particular towards a projection of the chair in a vertically oriented plane arranged next to this other side of the chair).

The embodiment of the chair according to the invention thus provides an arrangement of the two pivot joints that connect the seat shell to the frame in the sagittal plane of a user of the chair. This makes it possible to achieve the desired movability in connection with the deformable seat shell, the number of parts required for the formation of the frame being reduced by comparison with the chair known from DE 10 2011 001 811 A1. In particular, instead of the two struts forming a backrest support, which are connected in the case of the chair according to DE 10 2011 001 811 A1 by means of two respective pivot joints to a seat base and the backrest, a one-piece backrest support can be used, which is connected to the backrest by means of only one pivot joint, which can preferably be in the form of a ball joint. Moreover, it can be provided for the backrest support to also integrate the first pivot joint by means of which the frame is connected to the seat part of the seat shell.

In order to allow the greatest possible deformation of the seat shell, it can preferably be provided for the first pivot joint to allow a twisting about at least one (and optionally only this one) first axis of rotation which is oriented in the vertical direction of the chair. It can likewise be provided for the second pivot joint to allow a twisting about at least one (and optionally only this one) second axis of rotation which is oriented in the longitudinal direction of the chair.

In this case, the "vertical direction" of the chair shall be understood to be any direction which extends from an underside of the chair (in particular from a projection of the chair in a horizontally oriented plane arranged underneath the chair) towards an upper side of the chair (in particular towards a projection of the chair in a horizontally oriented plane above the chair). Accordingly, the longitudinal direction of the chair shall be understood to be any direction which extends from an rear side of the chair (in particular from a projection of the chair in a vertically oriented plane arranged behind the chair) towards a front side of the chair (in particular towards a projection of the chair in a vertically oriented plane arranged on the front side of the chair).

In a preferred embodiment of the chair according to the invention, it can be provided for the seat part to also be connected to the frame by means of at least one bearing, the bearing being formed such that it prevents a twisting of the seat part about an axis which is oriented in a longitudinal direction of the chair. As a result of this, the seat shell is provided with stability in the region of the seat part which prevents a sideways tipping of the seat shell in the region of the front edge of the seat in the event of an eccentric load from the user. If the bearing is positioned accordingly, in particular near the front edge of the seat, it also does not prevent the intended deformability of the seat shell within the scope of the use of the chair.

The bearing can be functionally integrated into the first pivot joint. It can, however, be advantageous if the bearing is formed separately from the first pivot joint and in particular is arranged at a distance therefrom in the transverse direction of the chair.

More preferably, at least two of such bearings can be provided and arranged at a distance on either side of the first pivot joint.

A structurally simple and functionally advantageous embodiment of the bearing or bearings can provide for two bearing parts, of which one is connected to the frame and the other is connected to the seat shell, to be movable towards one another in a plane extending in the transverse direction and longitudinal direction of the chair.

In order to allow the greatest possible deformation of the seat shell, it can furthermore be provided in the case of the chair according to the invention for the first pivot joint to be arranged in the half of the seat part comprising the front edge of the seat, preferably in the third or quarter of the seat part comprising the front edge of the seat and more preferably in the fifth of the seat part comprising the front edge of the seat (each in relation to the extension of the seat part in the longitudinal direction of the chair).

For the same purpose, the second pivot joint can be arranged above the centre of gravity of a (standard) user. In this case, the second pivot joint can be arranged in particular in the half of the backrest comprising the upper edge of the backrest (in relation to the extension of the backrest in the vertical direction of the chair).

In this case, "standard user" shall be understood to mean, for example, the $95^{th}$ percentile of adult persons.

In a further preferred embodiment of the chair according to the invention, it can be provided for a backrest support of the frame, which is connected to the backrest by means of the second pivot joint, to be connected by means of a third pivot joint to a seat base of the frame that is connected to the seat part by means of the first pivot joint. In this case, the third pivot joint defines an axis of rotation which is oriented in a transverse direction of the chair. In particular, it can be provided for the third pivot joint to be at a distance from the first pivot joint in the longitudinal direction of the chair, the at least one axis of rotation defined by the first pivot joint and the at least one axis of rotation defined by the third pivot joint thus not intersecting. As a result of such an embodiment of the chair according to the invention, a tilting movability is generated for the chair which is generally found to be advantageous by users.

A tilting movability of this type is found to be particularly advantageous if leaning back is associated with at least a slight stretching of the body. Accordingly, it can preferably be provided in the case of the chair according to the invention for it to be adjustable between at least one upright first position and a backwardly tilted second position, an angle between the seat part and the backrest in the second position being greater than in the first position.

Such a change in angle between the seat part and the backrest can be achieved in a structurally simple manner in that the backrest support is L-shaped or arched, a first leg of the L-shaped backrest support or a first half of the arched backrest support being connected to the seat base by means of the third pivot joint and a second leg of the L-shaped backrest support or a second half of the arched backrest support being connected to the backrest by means of the second pivot joint.

Furthermore, in order to prevent a disadvantageous deformation of the seat shell in particular when achieving a tilting movability of the chair, it can preferably be provided for the first pivot joint to allow a twisting of the seat part relative to the corresponding portion of the frame about an axis of rotation which is oriented in the transverse direction of the chair and/or for the second pivot joint to allow a twisting of the backrest relative to the corresponding portion of the frame about an axis of rotation which is oriented in the transverse direction of the chair.

It is may be found to be particularly advantageous if a raising of the seat part, in particular the front edge of the seat on the seat part, takes place at the same time as the backward tilting of the backrest. Accordingly, it can preferably be provided for the frame to be designed such that a twisting of the backrest support about the axis of rotation of the third pivot joint and, optionally, of the first pivot joint, leads to a movement of the front edge of the seat in the vertical direction of the chair.

This functionality of the chair can be used in a structurally advantageous manner if the seat part is fixed to a cross beam, in particular by means of the first pivot joint, the cross beam being rotatably connected to a lever (in particular at one end of this lever) and the lever (in particular at the other end thereof) being rotatably connected to the seat base and a rotational movement of the lever relative to the seat base being coupled to a rotational movement of the backrest support about the axis of rotation of the third pivot joint by means of a rod.

Again, in order to improve the convenience of use of the chair, said chair can preferably be designed as a revolving chair, in which a seat base of the frame, which is connected to the seat part by means of the first pivot joint, is connected to a foot part of the frame by means of a pivot joint.

The seat shell of the chair can preferably be integrally formed such that the seat part and the (still preferably one-piece) backrest transition into one another.

Alternatively, however, it can also be provided for the seat shell to comprise a seat part and a backrest, which are formed as separate components, as well as a support connecting the seat part and the backrest. The support can preferably be formed as a bar, for example extending in an L-shape or an arch, and be arranged centrally in relation to the transverse direction of the chair. Furthermore, it can preferably be provided for the deformation of the seat shell to be made possible or accommodated by the support in particular. An embodiment of the support in the form of a (single-layered or multi-layered) leaf spring can, for example, be advantageous for this purpose. Such an embodiment of the seat shell of the chair according to the invention makes it possible to form the seat part and the backrest as relatively rigid components, whereas the deformable support ensures the deformability of the seat shell as a whole using relatively low forces.

Such a chair according to the invention can further be designed such that the seat part is mounted in a movable manner on the frame in the longitudinal direction of the chair and/or the backrest is/are mounted in a movable manner on the frame in the vertical direction of the chair. In this case, the movability can be provided so as to be only temporary after a release of a locking device. This allows the most optimal adjustment possible of the seat shell to various body dimensions of users.

The invention is described in greater detail below with reference to the embodiments shown in the drawings, which are all schematic and in which:

DETAILED DESCRIPTION OF ILLUSTRATIVE EMBODIMENTS

Figure 3:
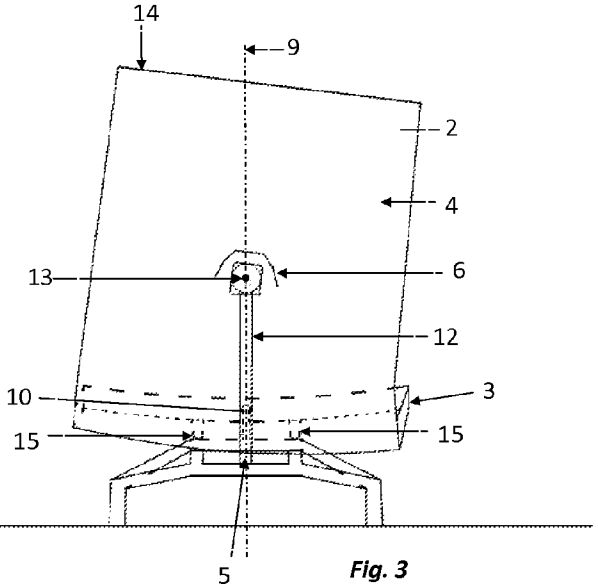
FIG. 3: is a view according to FIG. 2 when the seat shell of the chair is deformed.
Figure 2:
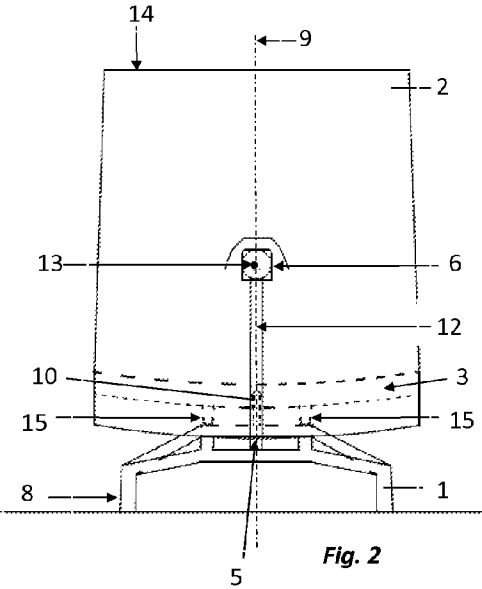
FIG. 2: is a view from behind of the chair according to FIG. 1 having an undeformed seat shell.
Figure 1:
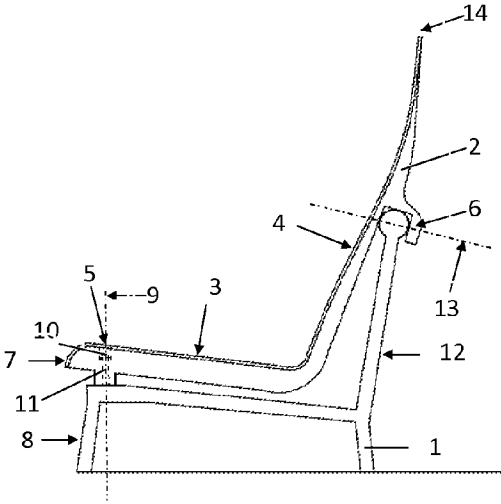
FIG. 1: is a side view of a first embodiment of a chair according to the invention.
Figure 5:
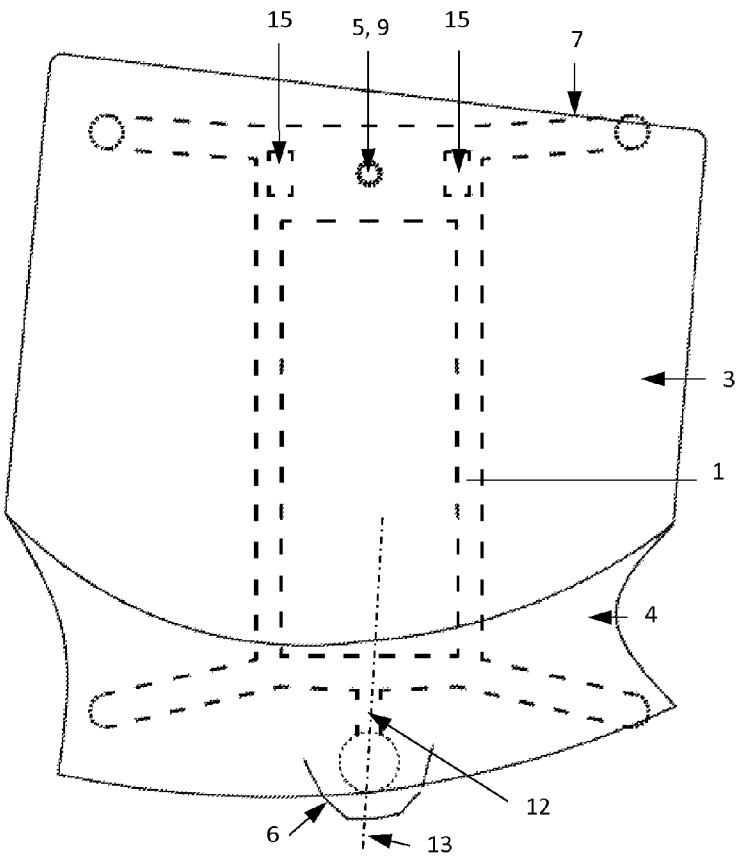
FIG. 5: is a view according to FIG. 4 when the seat shell of the chair is deformed.
Figure 4:
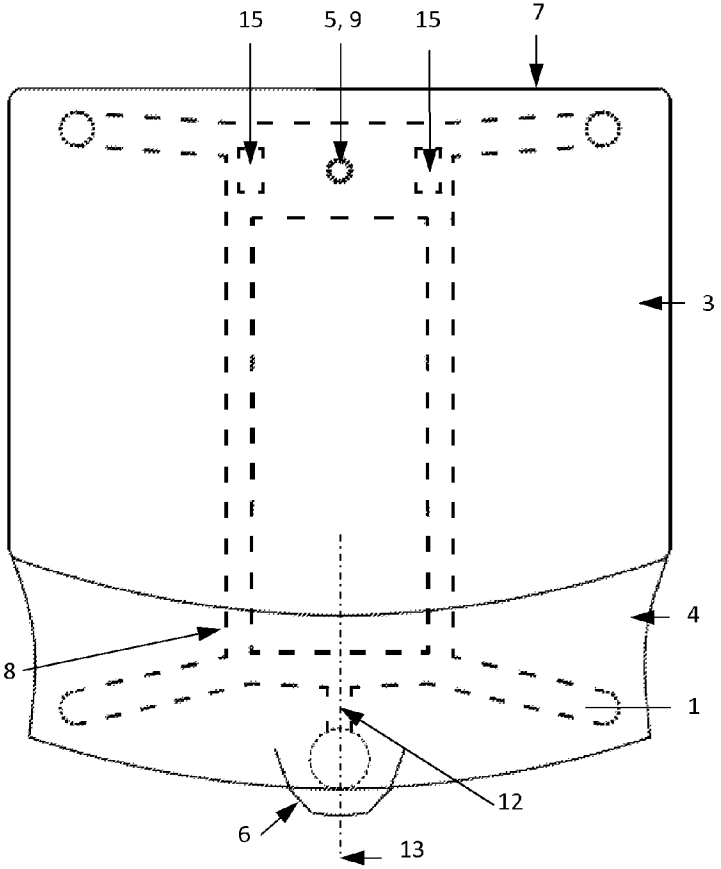
FIG. 4: is a view from above of the chair according to FIG. 1 having an undeformed seat shell.

The chair shown in FIG. 1 to 5 comprises a frame 1 and a seat shell 2 connected to the frame 1.

The frame 1 is substantially rigid. Said frame is thus designed such that it does not deform functionally when the chair is used as intended. The frame 1 can be formed in one piece, for example from welded-together tubes. It forms for example four feet, as shown, by means of which the chair can be placed on a subsurface.

The seat shell 2 is integrally formed such that a portion used as a seat part 3 transitions into a portion used as a backrest 4 of the seat shell 2. In this case, the seat shell 2 can be formed in one or more pieces (in particular having a then preferably one-piece seat shell upper part and a frame supporting the seat shell upper part) (cf. also FIGS. 14 and 15).

The seat shell is connected to the frame 1 by means of two pivot joints 5, 6. In this case, a first pivot joint 5 is arranged near the front edge of the seat 7 of the seat shell 2. The first pivot joint 5 is positioned centrally in relation to the transverse direction of the chair and thus approximately in the sagittal plane of a user. The first pivot joint 5 allows a twisting of the portion of the seat shell 2 that is connected to this pivot joint 5, specifically substantially of the whole seat part 3, relative to the corresponding portion of the frame 1 (the seat base 8) about a first axis of rotation 9.

This first axis of rotation 9 extends in the vertical direction of the chair. Specifically, it is oriented approximately vertically (when the chair is standing on a horizontal subsurface). The first pivot joint 5 can be formed such that a pin 10 that is connected to the seat base 8 (or the seat part 3) is rotatably mounted in a bushing 11 that is connected to the seat part 3 (or the seat base 8).

A second pivot joint 6 connects the seat shell 2 in the region of the backrest 4 to a backrest support 12 of the frame 1. In this case, the second pivot joint 6 is arranged centrally in relation to the transverse direction of the chair and thus—as in the case of the first pivot joint 5—approximately in the sagittal plane of a user of the chair. The second pivot joint 6 is formed as a ball joint. This accordingly allows a twisting of the backrest 4 relative to the backrest support 12 about a plurality of axes, inter alia about at least one axis of rotation 13 extending in the longitudinal direction of the chair.

Figure 11:
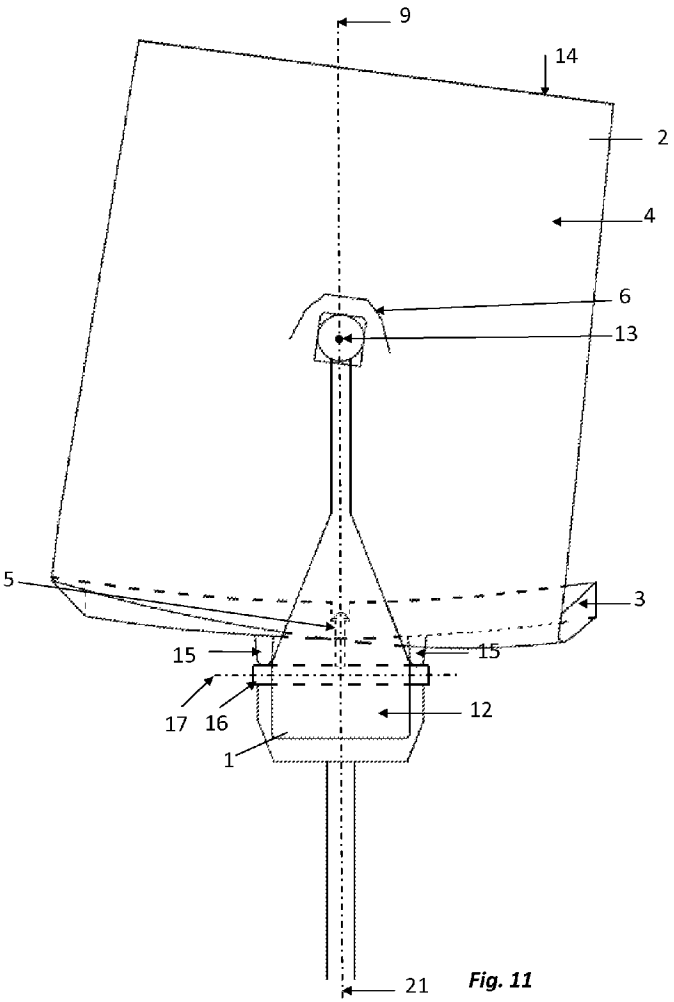
FIG. 11: is a view according to FIG. 10 when the seat shell is deformed.
Figure 10:
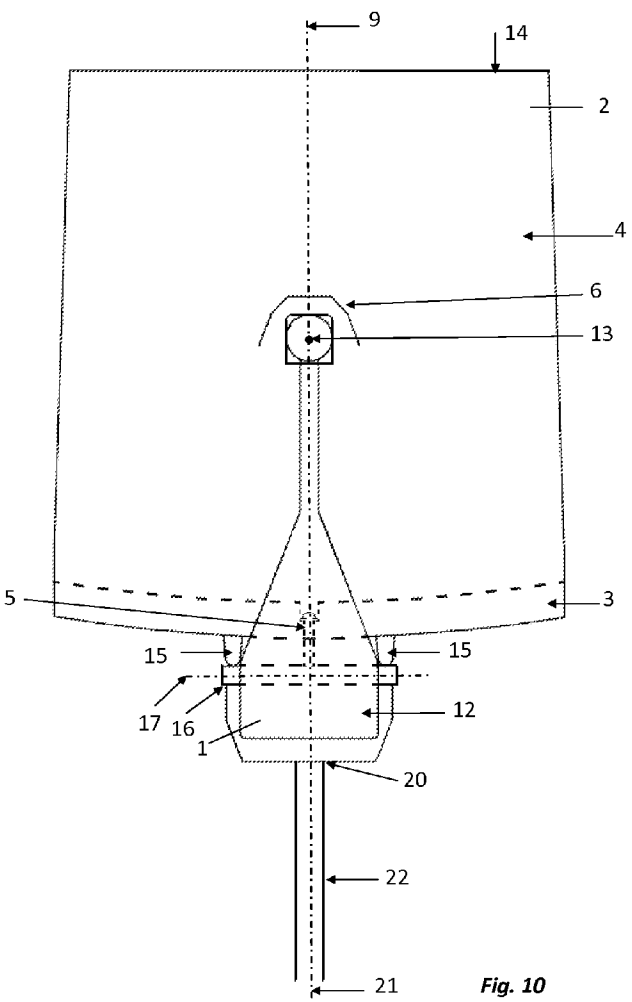
FIG. 10: is a view from behind of a chair according to FIG. 6 to 9 having an undeformed seat shell.

The mounting of the seat shell 2 according to the invention allows a deformation of the seat shell 2 caused by a shift in weight by a user in which said seat shell is moved to one side in the transition from the seat part 3 to the backrest 4 while the front edge of the seat 7 and the edge of the backrest 14 are tilted towards the other side (cf. FIGS. 3 and 11).

Figure 13:
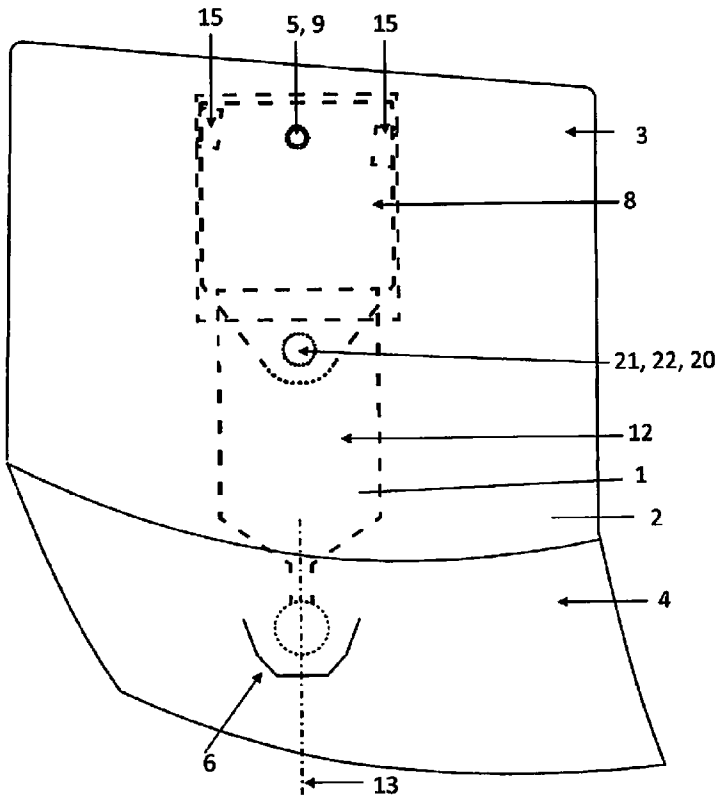
FIG. 13: is a view according to FIG. 12 when the seat shell is deformed and in a backwardly tilted position.
Figure 12:
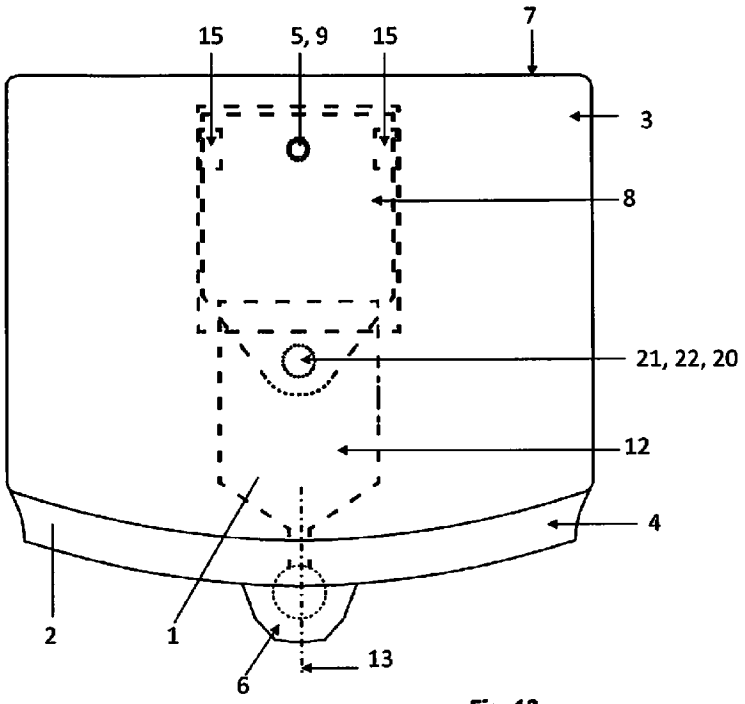
FIG. 12: is a view from above of a chair according to FIG. 6 to 9 having an undeformed seat shell in an upright position.

Furthermore, the seat part 3 of the seat shell 2 is connected to the frame 1 by means of two bearings 15. Each bearing 15 is arranged at a distance from the first pivot bearing 5 in the transverse direction of the chair. With respect to the longitudinal direction of the chair, the bearings 15 are located at the level of the first pivot bearing 5 and of the front edge of the seat 7. The two bearings 15 are formed such that they at least support, i.e. prevent, a load in the vertical direction, i.e. from above to below. As a result, a twisting of the front portion of the seat part 3 about an axis which is oriented in the longitudinal direction of the chair and consequently a sideways tipping of a user together with the seat shell 2 is prevented. In this case, the bearings 15 are formed such that a movability of the seat part 3 relative to the frame 1 in the region of the bearings 15 in a plane that extends in the longitudinal direction and the transverse direction of the chair, is possible (cf. FIGS. 4 and 5 as well as FIGS. 12 and 13). As a result, the desired deformability of the seat shell 2 is not prevented by the bearings 15. This movability of the bearings 15 can be achieved in that two respective bearing parts abut each other in a sliding manner and as a result form a corresponding slide bearing. One bearing part can be connected to the frame 1 or be formed by said frame and the other bearing part can be connected to the seat part 3 of the seat shell 2 or be formed by said seat part.

If the bearings 15 are also each intended to support a load in the vertical direction, i.e. from below to above, it can be provided for one of the bearing parts of each bearing 15 to form a slot through which a guide pin of the other bearing part extends, the edge of the slot engaging at least on one side, preferably on two sides, in a groove formed in the casing of the guide pin.

Figure 7:
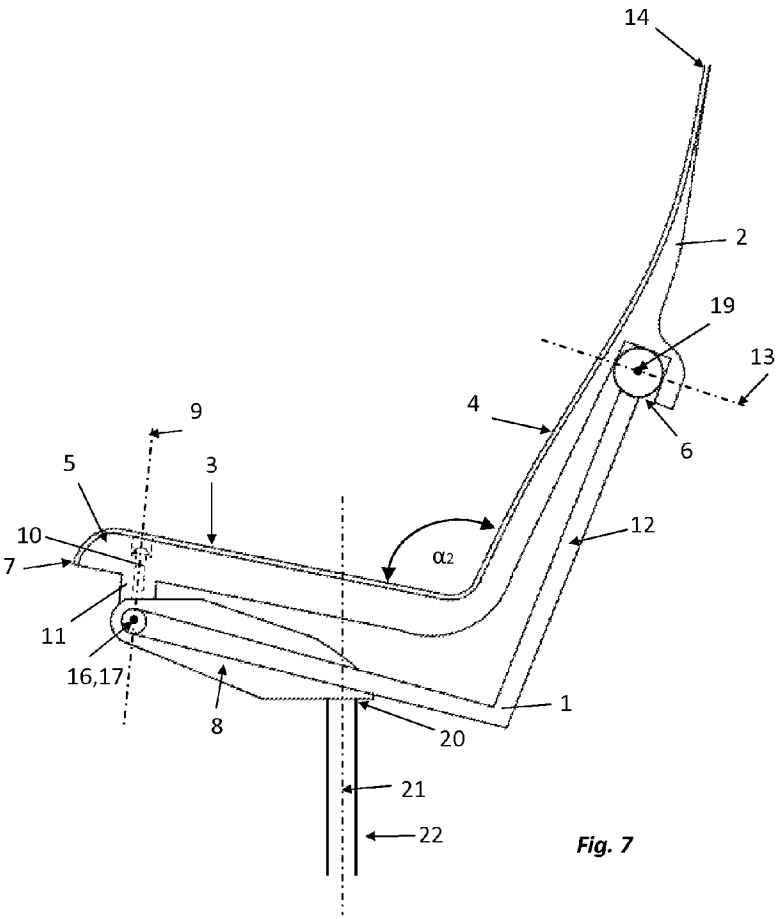
FIG. 7: is a view according to FIG. 6 when the seat shell is in a backwardly tilted position.
Figure 6:
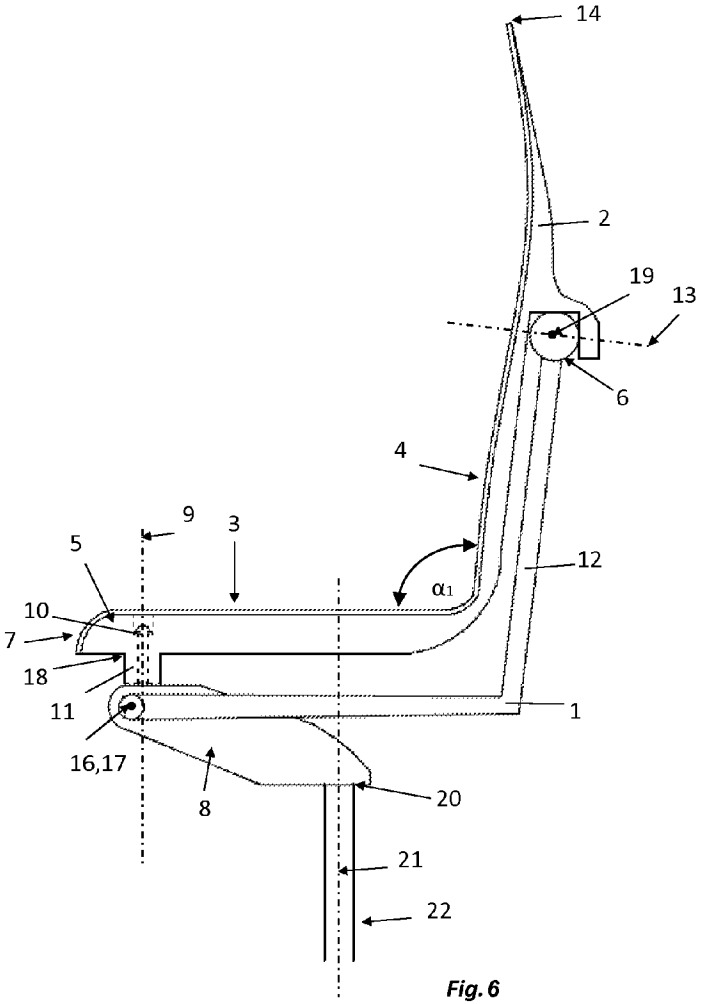
FIG. 6: is a side view of a second embodiment of a chair according to the invention when the seat shell is in an upright position.

The chair shown in FIGS. 6 and 7 and in 10 to 13 differs from the chair shown in FIG. 1 to 5 firstly by the integration of a tilting movability of the seat shell 2. For this purpose, the backrest support 12 of the frame 1 is formed so as to be structurally separate from the seat base 8 of the frame 1 and is rotatably connected to the seat base 8 by means of a third pivot joint 16 about a third axis of rotation 17, which extends in the transverse direction of the chair. The third axis of rotation 17 extends near the first pivot joint 5. In particular, it can be provided for the third axis of rotation 17 to intersect the first axis of rotation 9 that extends in the vertical direction and is formed by the first pivot joint 5.

The backrest support 12 is L-shaped, the free end of one leg being connected by means of the second pivot joint 6 to the backrest 4 of the seat shell 2 and the free end of the other leg being connected by means of the third pivot joint 16 to the seat base 8. The backrest support 12 can also, however, also be arched.

In order to not impede the tilting movability of the seat shell 2, the first pivot joint 5 and the second pivot joint 6 are formed such that they allow a twisting of the corresponding portion of the seat shell 2 relative to the corresponding portion of the frame 1 in each case also about a fourth axis of rotation 18 and a fifth axis of rotation 19 respectively, which are oriented in the transverse direction of the chair. In the case of the second pivot joint 6, this rotatability results from its design as a ball joint. For the first pivot joint 5, in contrast, this rotatability results from the deformability of the seat shell, as shown in FIGS. 6 and 7. There is, however, also the possibility of forming the first pivot joint 5 as a ball joint or in another manner with two pivot joint parts movably connected to one another about the corresponding axes of rotation 9, 18. In particular, in one design of the first pivot joint 5 in which said pivot joint has a pin 10 connected to the seat base 8 (or the seat part 3 of the seat shell 2) that is rotatably mounted in a bushing 11, which is connected to the seat part 3 (or the seat base 8), it can also be provided that the pin 10 (or the bushing 11) is connected to a cross beam, at the end of which the corresponding end of the L-shaped backrest support 12 also engages. In this case, the cross beam can be mounted rotatably in the seat base 8 while the backrest support 12 and/or the pin 10 (or the bushing 11) can engage firmly on the cross beam. In this case, the cross beam that is rotatably mounted in the seat base 8 forms the third pivot joint 16 as well as part of the first pivot joint 5. It is also possible for the cross beam to be firmly integrated into the seat base 8, while the backrest support 12 and the pin 10 (or the bushing 11) are rotatably fixed to said cross beam.

As a result of the distance of the third axis of rotation 17 from the fourth axis of rotation 18 formed by the first pivot joint 5 extending in the transverse direction of the chair, the (direct) distance between the fourth axis of rotation 18 and the second pivot bearing 6 changes when the seat shell 2 is tilted backwards. This leads to a deformation of the seat shell 2, where an angle $\alpha$ formed between the seat part 3 and the backrest 4 increases ($\alpha_1<\alpha_2$).

Moreover, the chair shown in FIGS. 6 and 7 and in 10 to 13 is designed as a revolving chair. For this purpose, the seat base 8 of the frame 1 is rotatably connected to a foot part 22, shown only in part, of the frame 1 by means of a fourth pivot joint 20 about a sixth axis of rotation 21 extending in the vertical direction of the chair, which is specifically approximately vertically oriented.

Figure 9:
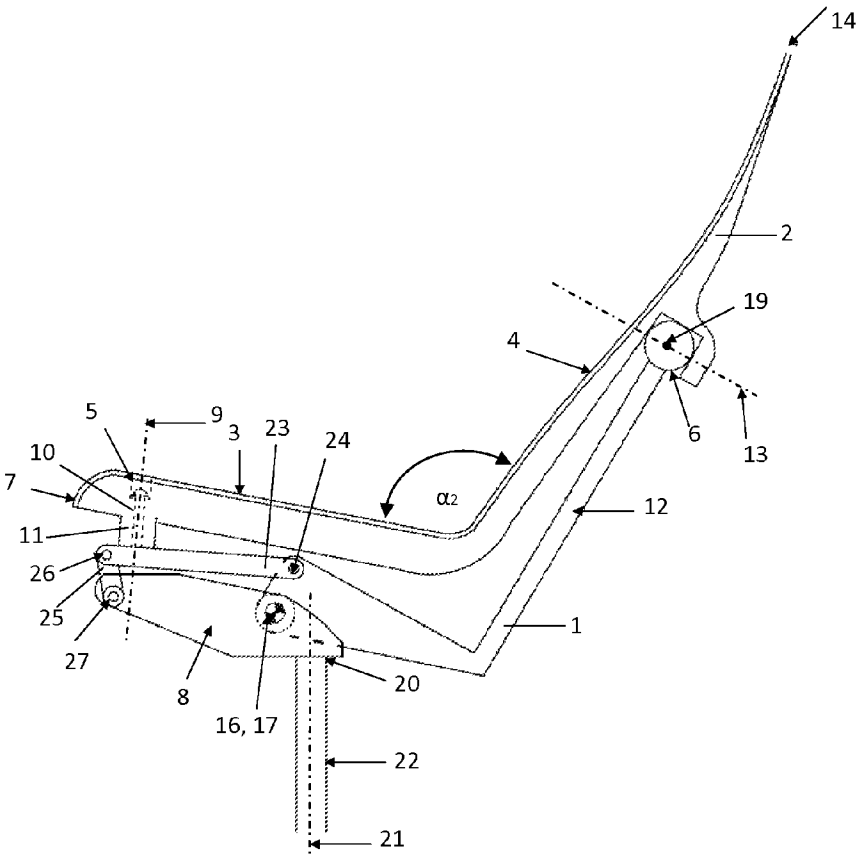
FIG. 9: is a view according to FIG. 8 when the seat shell is in a backwardly tilted position.
Figure 8:
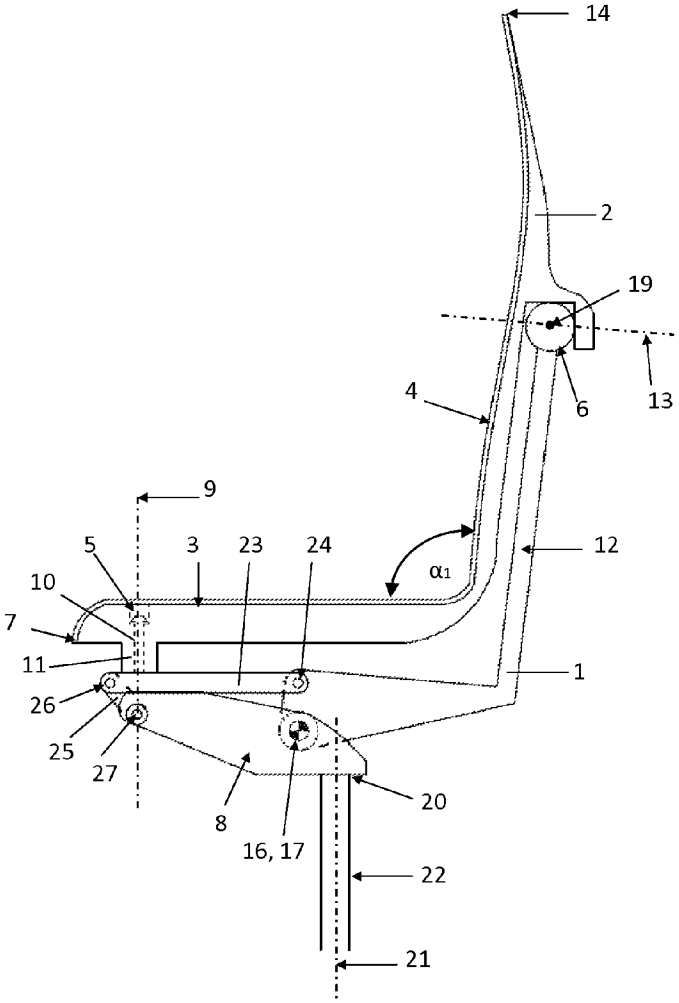
FIG. 8: is a side view of a third embodiment of a chair according to the invention when the seat shell is in an upright position.

The chair shown in FIGS. 8 and 9 and in 10 to 13 differs from the chair shown in FIGS. 6 and 7 and in 10 to 13 in particular by additional kinematics, which ensure that a backward tilting of the seat shell 2 is accompanied by a raising (in the vertical direction) of the first pivot joint 5 and thus the front edge of the seat 7.

For this purpose, the third pivot joint 16, by means of which the backrest support 12 is connected to the seat base 8, is arranged further back. Moreover, two more rods 23 (one on either side of the backrest support 12) are rotatably connected to the backrest support 12 at the same end as the third pivot joint 16 and about a seventh axis of rotation 24. The seventh axis of rotation 24 is arranged at a distance from the third axis of rotation 17 formed by the third pivot bearing 16.

The rods 23 each extend up to one end of a respective lever 25, to which they are rotatably connected about an eighth axis of rotation 26 extending in the transverse direction of the chair. The respective other end of the lever 25 is rotatably connected to the seat base 8 about a ninth axis of rotation 27 extending in the transverse direction of the chair. A distance is thus also produced between the eighth axis of rotation 26 and the ninth axis of rotation 27. The ninth axis of rotation 27 is approximately positioned in the manner of the third axis of rotation 17 in the case of the chair according to FIGS. 6 and 7.

The first pivot joint 5 is connected to the two rods 23 near the eighth axis of rotation by means of a cross beam. Said cross beam can, however, also be connected in turn to the two levers 25, near the eighth axis of rotation. As a result of this linking of the first pivot joint 5 in conjunction with the distances formed between the third axis of rotation 17 and the seventh axis of rotation 24 on the one hand and the eighth axis of rotation 26 and the ninth axis of rotation 27 on the other, the desired height adjustment of the first pivot bearing 5 and thus of the front edge of the seat 7, which is coupled to an adjustment of the tilting of the seat shell 2, is produced.

Also in the case of the chair according to FIGS. 8 and 9, a backward tilting of the seat shell 2 leads to an increase of an angle $\alpha$ formed between the seat part and the backrest ($\alpha_1<\alpha_2$).

Figure 15:
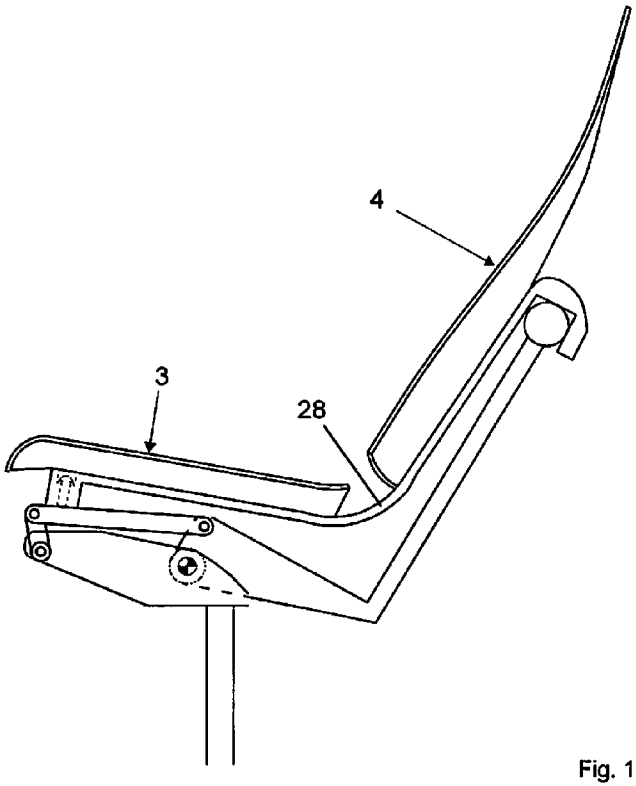
FIG. 15: is a view according to FIG. 14 in which the seat shell is in a backwardly tilted position.
Figure 14:
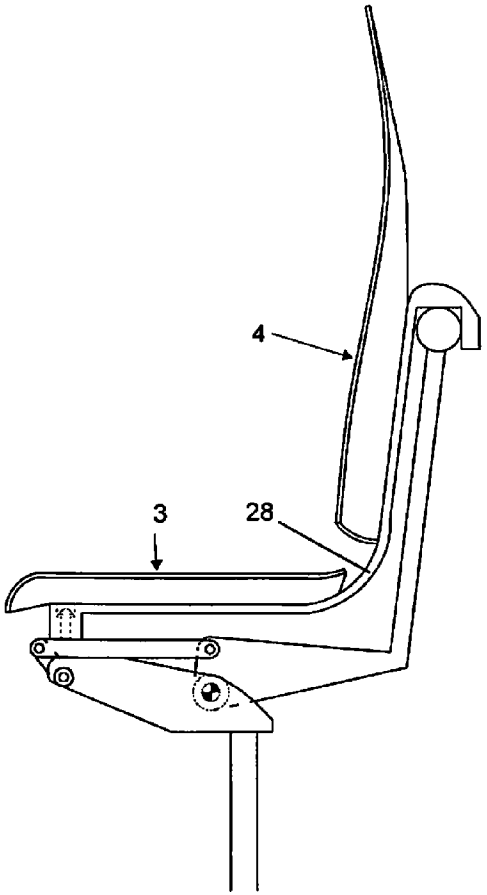
FIG. 14: is a side view of a fourth embodiment of a chair according to the invention in which the seat shell is in an upright position.

FIGS. 14 and 15 show an embodiment of a chair according to the invention, which differs from that shown in FIGS. 8 and 9 in that the seat shell 2 is not formed integrally but rather of more than one part. Said seat shell comprises a seat part 3 and a backrest 4, which are formed as separate components at a distance from one another and are connected to one another by means of a support 28. The support 28 substantially constitutes the component of the seat shell 2 that facilitates the deformability of the seat shell 2. The support 28 is designed as a guide rail arranged centrally in relation to the transverse direction of the chair on which the seat part 3 and the backrest 4 are guided in a longitudinally movable manner. As a result of such movement and the possibility of fixing the seat part 3 and the backrest 4 in various positions by means of a locking device (not shown) in an interlocking or force-fitting manner, an advantageous adaptation of the chair to different body dimensions of users is made possible.

LIST OF REFERENCE NUMERALS

1 Frame
2 Seat shell
3 Seat part
4 Backrest
5 First pivot joint
6 Second pivot joint
7 Front edge of seat
8 Seat base
9 First axis of rotation
10 Pin
11 Bushing
12 Backrest support
13 Second axis of rotation
14 Edge of backrest
15 Bearing
16 Third pivot joint
17 Third axis of rotation
18 Fourth axis of rotation
19 Fifth axis of rotation
20 Fourth pivot joint
21 Sixth axis of rotation
22 Foot part
23 Rod
24 Seventh axis of rotation
25 Lever
26 Eighth axis of rotation
27 Ninth axis of rotation
28 Support

The invention claimed is:

1. A chair comprising:

a deformable seat shell forming a seat part and a backrest, and a frame, the seat part being connected to the frame by a first pivot joint, and the backrest being connected to the frame by a single second pivot joint, the first and second pivot joints allowing a twisting of the seat part and of the backrest relative to the frame caused by a deformation of the seat shell, wherein the second pivot joint is connected to the backrest centrally in relation to a transverse direction of the chair, and wherein the first pivot joint allows a twisting about a first axis of rotation oriented in a vertical direction of the chair, and the second pivot joint allows a twisting about a second axis of rotation oriented in a longitudinal direction of the chair.

2. The chair according to claim 1, characterised in that the first pivot joint allows a twisting about a first axis of rotation oriented in the vertical direction of the chair.

3. The chair according to claim 1, characterised in that the seat part is connected to the frame by means of at least one bearing, the bearing being formed such that it hinders a twisting of the seat part about an axis which is oriented in a longitudinal direction of the chair.

4. The chair according to claim 3, characterised in that the at least one bearing includes a first bearing and a second bearing, each arranged at a distance from the first pivot joint in the transverse direction of the chair, the first bearing and second bearing being movable towards one another in a plane extending in the transverse direction and longitudinal direction of the chair.

5. The chair according to claim 1, characterised in that a backrest support is connected to the backrest by the second pivot joint, and is rotatably connected to a seat base of the frame by a third pivot joint about an axis of rotation oriented in the transverse direction of the chair, the seat base of the frame being connected to the seat part by the first pivot joint.

6. The chair according to claim 5, characterised in that it is adjustable between at least one upright first position and a backwardly tilted second position, an angle ($\alpha$) between the seat part and the backrest being greater in the second position than in the first position.

7. The chair according to claim 5, characterised in that the backrest support is L-shaped or arched, a first leg of the L-shaped backrest support or a first half of the arched backrest support being connected by means of the third pivot joint to the seat base and a second leg of the L-shaped backrest support or a second half of the arched backrest support being connected by means of the second pivot joint to the backrest.

8. The chair according to claim 1, characterised in that the first pivot joint allows a twisting of the seat part about an axis of rotation oriented in the transverse direction of the chair and/or the second pivot joint allows a twisting of the backrest about an axis of rotation which is oriented in the transverse direction of the chair.

9. The chair according to claim 5, characterised in that the frame is designed such that a twisting of the backrest support about the axis of rotation of the third pivot joint leads to a movement of a front edge of the seat in the vertical direction of the chair.

10. The chair according to claim 9, further comprising a lever and a rod and characterised in that the seat part is fixed to a cross beam, the cross beam being connected to the lever or the rod and the lever being rotatably connected to the seat base, whereas a rotational movement of the lever relative to the seat base is coupled by the rod to a rotational movement of the backrest support.

11. The chair according to claim 1, characterised in that the first pivot joint is arranged in the half of the seat part comprising a front edge of the seat.

12. The chair according to claim 1, characterised in that the second pivot joint is arranged above the centre of gravity of a user's body.

13. The chair according to claim 1, the frame further comprising a seat base connected to the seat part by the first pivot joint, and connected to a foot part of the frame by a foot part pivot joint.

14. The chair according to claim 1, characterised in that the seat shell comprises a seat part, a backrest and a support connecting the seat part and the backrest.

15. The chair according to claim 14, characterised in that the seat part is movably mounted on the frame in a longitudinal direction of the chair and/or the backrest is movably mounted on said frame in the vertical direction of the chair.

16. A chair comprising:

a deformable seat shell forming a seat part and a backrest, and a frame, the seat part being connected to the frame by means of a first pivot joint, and the backrest being connected to the frame by means of a second pivot joint, the pivot joints allowing a twisting of the seat part and of the backrest relative to the frame caused by a deformation of the seat shell, characterised in that the second pivot joint is connected to the backrest centrally in relation to the transverse direction of the chair, a backrest support is connected to the backrest by the second pivot joint, and is rotatably connected to a seat base of the frame by a third pivot joint about an axis of rotation oriented in the transverse direction of the chair, the seat base of the frame being connected to the seat part by the first pivot joint, the frame is designed such that a twisting of the backrest support about the axis of rotation of the third pivot joint leads to a movement of a front edge of the seat in the vertical direction of the chair, and the chair further comprises:

a lever and a rod, wherein the seat part is fixed to a cross beam, the cross beam being connected to the lever or the rod, and the lever being rotatably connected to the seat base, wherein a rotational movement of the lever relative to the seat base is coupled by the rod to a rotational movement of the backrest support.

* * * * *